US007179123B2

(12) United States Patent
Ohara

(10) Patent No.: US 7,179,123 B2
(45) Date of Patent: Feb. 20, 2007

(54) TERMINAL AND A CONNECTOR PROVIDED WITH SUCH A TERMINAL

(75) Inventor: Koji Ohara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/885,160

(22) Filed: Jul. 6, 2004

(65) Prior Publication Data

US 2005/0074999 A1 Apr. 7, 2005

(30) Foreign Application Priority Data

Oct. 7, 2003 (JP) ..... 2003-195065

(51) Int. Cl.
*H01R 13/40* (2006.01)

(52) U.S. Cl. ..... 439/595; 439/733.1

(58) Field of Classification Search ..... 439/567, 439/595, 733.1, 82, 83
See application file for complete search history.

(56) References Cited

U.S. PATENT DOCUMENTS 6,811,449 B2 * 11/2004 Yamashita ..... 439/733.1
6,896,559 B2 * 5/2005 Klein et al. ..... 439/733.1

FOREIGN PATENT DOCUMENTS

JP 8-321342 12/1996

* cited by examiner

*Primary Examiner*—Khiem Nguyen
(74) *Attorney, Agent, or Firm*—Gerald E. Hespos; Anthony J. Casella

(57) ABSTRACT

A connector (1) is provided with a housing (10) formed with press-in holes (17), and terminals (20) to be pressed into the press-in holes (17). Each terminal (20) includes a tab (21) connectable with a mating terminal, a base (22) extending from the tab (21), and two press-in portions (23, 25) arranged side-by-side along the longitudinal direction on the base (22). Each press-in portion (23, 25) has press-in pieces (24*a*, 24*b*; 26*a*, 26*b*) projecting from the base (22) in substantially opposite outward directions and pressed into the housing (10). The respective press-in pieces (24*a*, 24*b*, 26*a*, 26*b*) are displaced from each other when the terminal (20) is viewed in the longitudinal direction.

10 Claims, 5 Drawing Sheets

TERMINAL AND A CONNECTOR PROVIDED WITH SUCH A TERMINAL

BACKGROUND OF THE INVENTION

1. Field of the Invention

The invention relates to a terminal to be pressed into a connector housing and to a connector with such a terminal.

2. Description of the Related Art

Japanese Unexamined Patent Publication No. H08-321342 discloses a connector with a housing and a terminal that can be pressed into the housing. Press-in portions are formed on side surfaces of the terminal.

The number of the press-in portions could be increased in an effort to increase the force for holding the terminal fitting in the housing. However, each press-in portion scrapes the housing and removes resin that could otherwise be engaged by subsequent press-in portions. Thus, the holding forces of press-in portions pressed in later are reduced due to the resin removed as the previous press-in portions on the same side of the terminal are pressed into the housing. Therefore, the entire holding force is not enhanced considerably.

The holding forces of the later-inserted press-in portions can be enhanced by making the terminal wider at the later-inserted press-in portions than at the earlier-inserted press-in portions. However, the terminal becomes large if too many press-in portions are formed along the pressing direction on one side surface. Further, there is a limit in the dimension of a portion of the housing where the terminal is pressed in. Accordingly, it is difficult to form many press-in portions on one side of the terminal.

The present invention was developed in view of the above problems and an object thereof is to provide a terminal to be held in a connector housing with a larger force and a connector provided with such a terminal.

SUMMARY OF THE INVENTION

The invention relates to a terminal, comprising a tab that is connectable with a mating terminal, a base extending from the tab, and press-in portions arranged substantially side by side along the longitudinal direction on the base. Each press-in portion includes press-in pieces that project transversely out from the base for being pressed into a housing. The press-in pieces are offset from each other when the terminal is viewed in the longitudinal direction. Thus, the press-in pieces of a plurality of side-by-side press-in portions do not scrape the housing at the same position when the terminal is pressed into the housing and the terminal can be held in the housing with a larger force. Further, the widths of the respective press-in pieces need not be different from each other, and the terminal can be miniaturized.

Two press-in portions preferably are arranged substantially side-by-side along the longitudinal direction. Each press press-in portion has press-in pieces that project from the base in substantially opposite directions. Leading ends of the press-in pieces are on diagonal corners of an imaginary rectangle. Thus, the terminal can be pressed into a middle part of the rectangular cavity in a well-balanced manner, and a variation in the position of the terminal in the housing can be reduced.

The press-in portions each may have a substantially crank shape.

The press-in pieces may have leading ends located on an imaginary circle. Thus, the terminal can be pressed in a well-balanced manner into a middle part of the cavity inscribed in or circumscribed by the imaginary circle. Thus, a variation in the position of the terminal in the housing can be reduced.

The leading ends of the press-in pieces preferably are circumferentially distributed around the imaginary circle.

The invention also relates to a connector that comprises a housing including at least one cavity, and at least one of the above-described terminals accommodated in the cavity.

Corners at the opposite leading ends of the press-in pieces preferably engage wails defining the corners of the cavity when the terminal is pressed into the housing. Thus, the housing is scraped at eight distributed positions by the press-in pieces. Accordingly, the force for holding the terminal is increased and a scraped amount of the housing at each press-in position is reduced. Therefore, the scraped amount of the housing is reduced, and the connector can be miniaturized.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
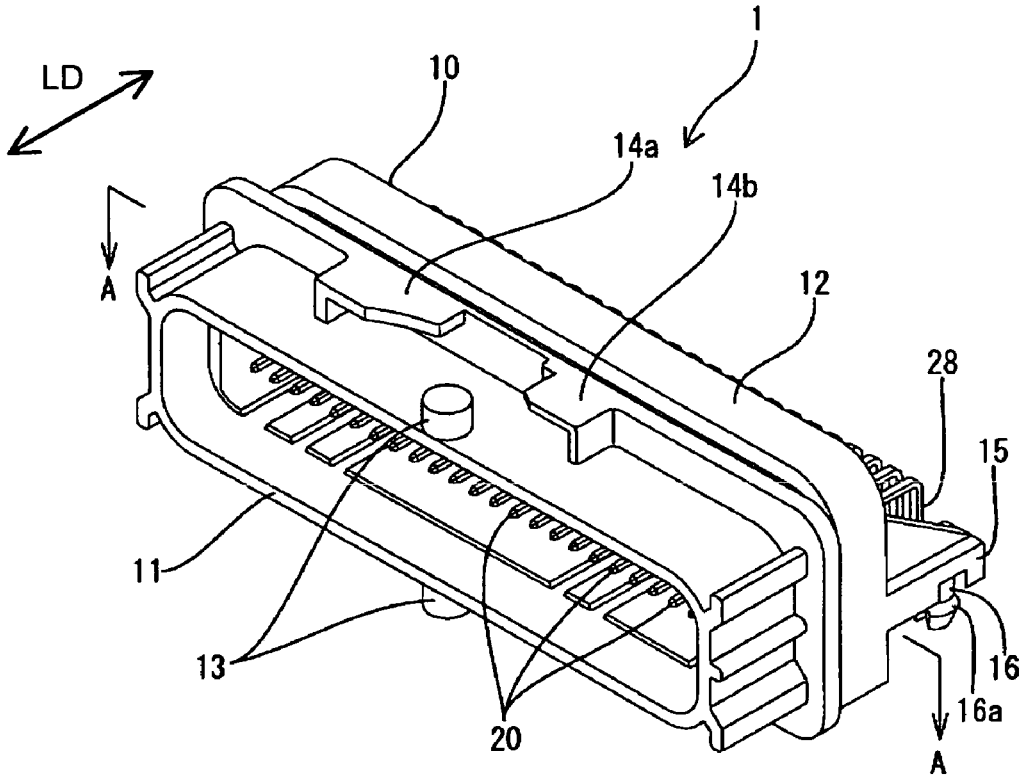
FIG. 1 is a perspective view of a connector according to a preferred embodiment of the invention.

A connector according to the invention is identified by the numeral 1 in FIG. 1. The connector 1 has a housing 10 that is formed unitarily of a synthetic resin. The housing 10 has a receptacle 11 configured for connection with an unillustrated mating connector. The housing 10 also has a terminal-accommodating portion 12 that is coupled to the receptacle 11. The connector 1 further includes terminals 20 that are pressed into the terminal-accommodating portion 12. In the following description, the end of the connector 1 that is to be connected with the mating connector is referred to as the front. Substantially cylindrical supporting shafts 13 are formed on the upper and lower sides of the outer surface of the receptacle 11 and a lock lever (not shown) is mounted pivotably on the supporting shafts 13 to connect the receptacle 11 with the mating connector.

Lever accommodating portions 14*a*, 14*b* (only upper one is shown in FIG. 1) are formed behind the supporting shafts 13 of the receptacle 11 for accommodating the lock lever before and after locking. Engaging portions 15 (only one is shown in FIG. 1) project at a rear side of the terminal accommodating portion 12, and projections 16 project down from the respective engaging portions 15. Resiliently deformable fasteners 16*a* extend in at the bottom ends of the respective projections 16 and are inserted into corresponding mount holes formed in an unillustrated device, such as an electronic circuit board to fix the lower surfaces of the engaging portions 15 by bringing them into contact with the electronic circuit board. In this way, the connector 1 is mounted on the electronic circuit board.

The terminals 20 are pressed into the terminal accommodating portion 12 of the housing 10 from behind, and rear portions of the terminals 20 are bent substantially in an L-shape to form vertical portions 28. The connector 1 is mounted on the circuit board so that the bottom ends of the vertical portions 28 enter holes of the circuit board and electrically connect with pattern circuits of the circuit board by, e.g. soldering, welding, press-fitting, etc.

Figure 2:
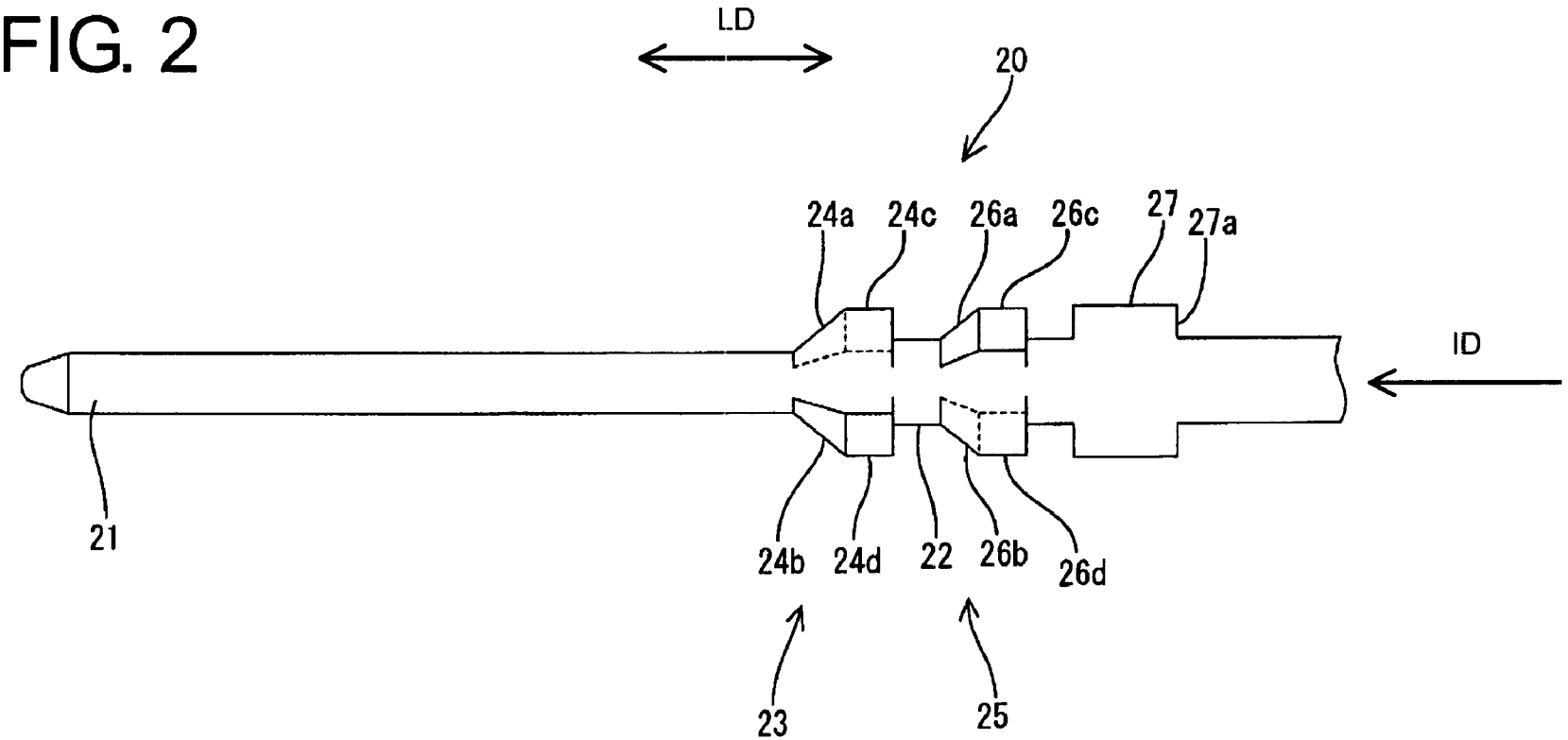
FIG. 2 is a plan view of a terminal used in the connector of FIG. 1.

Each terminal 20 is formed unitarily of an electrically conductive metal and has a bar-shaped tab 21 of substantially square cross-section for connection with a mating terminal when the connector 1 is connected with the mating connector, as shown in FIG. 2. A flat plate-shaped base 22 is coupled to the rear end of the tab 21 and extends substantially in a longitudinal direction LD. Front and rear press-in portions 23, 25 are provided on the base 22 one after the other along the longitudinal direction LD. The front press-in portion 23 includes two press-in pieces 24*a*, 24*b* that project out at an angle to the longitudinal direction LD, and the rear press-in portion 25 includes two press-in pieces 26*a*, 26*b* that project out at an angle to the longitudinal direction LD.

Figure 3:
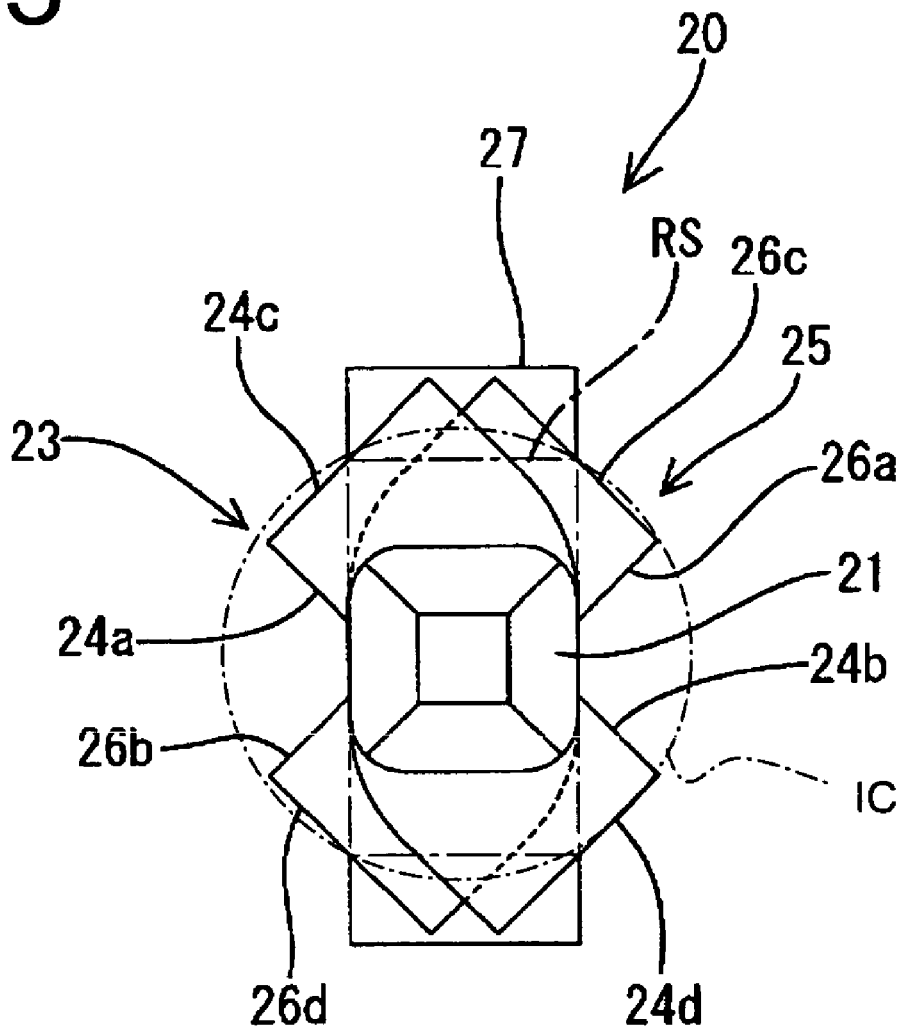
FIG. 3 is a left side view of the terminal of FIG. 2.

The press-in pieces 24*a*, 24*b* of the press-in portion 23 project in substantially opposite directions when the terminal is viewed from the front, as shown in FIG. 3, and the middles of the outer surfaces 24*c*, 24*d* of the press-in pieces 24*a*, 24*b* are on diagonal corners of a virtual rectangle RS that is depicted in phantom in FIG. 3. As a result, the press-in portion 23 has a substantially crank-shape or S-shape substantially centered on the tab 21. On the other hand, the press-in pieces 26*a*, 26*b* of the press-in portion 25 project in substantially opposite directions, and the middles of outer surfaces 26*c*, 26*d* of the press-in pieces 26*a*, 26*b* are on diagonal corners of the virtual rectangle RS. Thus, the press-in portion 25 also has a substantially crank-shape or S-shape substantially centered on the tab 21.

The respective press-in pieces 24*a*, 24*b*, 26*a*, 26*b* are displaced from each other along the circumference of an imaginary circle IC substantially centered on the longitudinal axis of the terminal 20, as shown in FIG. 3. As shown in FIG. 2, a receiving portion 27 is formed behind the press-in portion 25 and is comprised of projecting pieces that project out from the base 22 in substantially opposite directions. The receiving portion 27 can be pressed by an unillustrated terminal-pressing jig when the terminal 20 is pressed into the housing 10. A pressing surface 27*a* is formed at the rear end of the receiving portion 27 and receives forces of the terminal-pressing jig.

Figure 4:
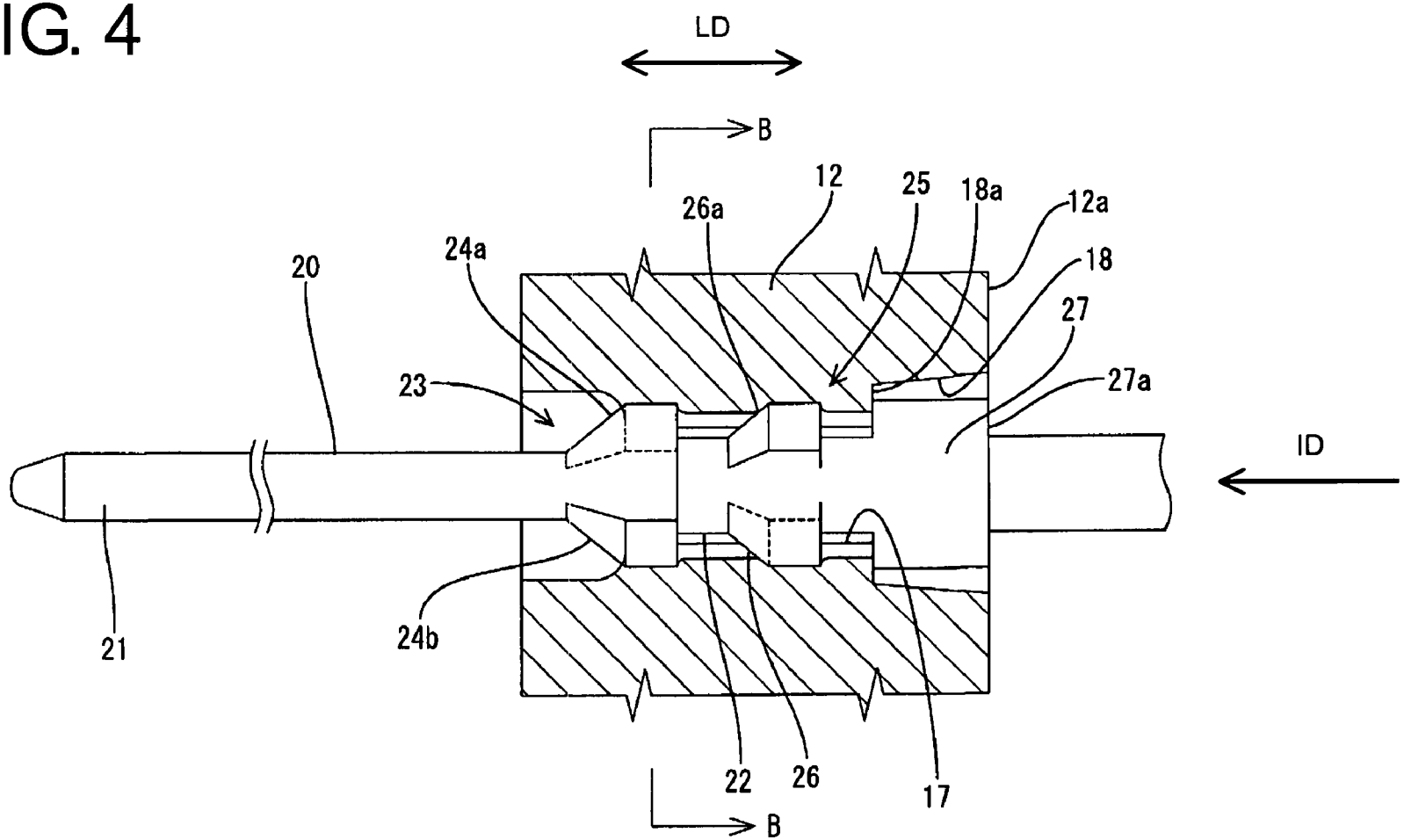
FIG. 4 is a partial section along 4—4 of FIG. 1.
Figure 5:
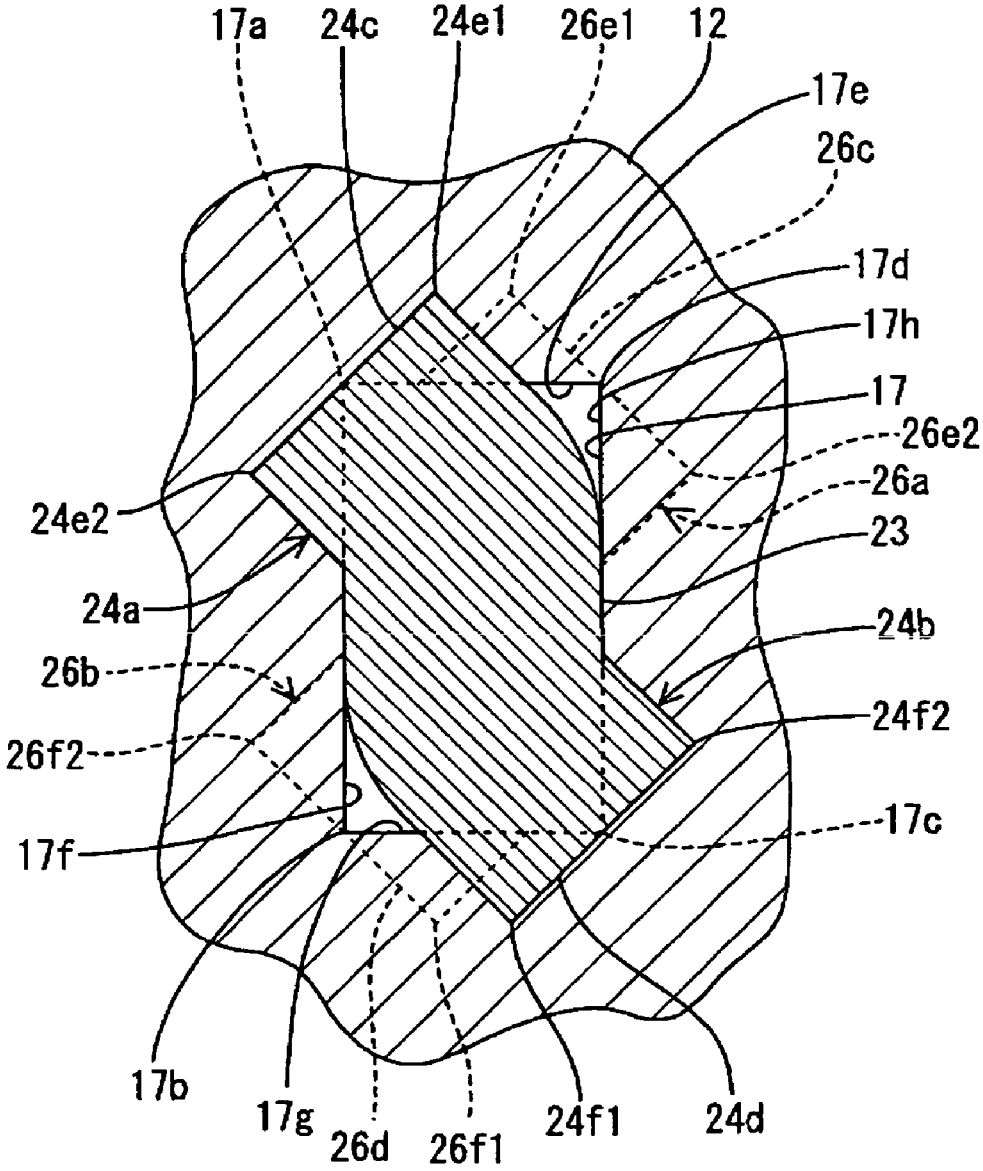
FIG. 5 is a section along 5—5 of FIG. 4.

As shown in FIGS. 4 and 5, press-in holes 17 of substantially rectangular cross section penetrate the terminal accommodating portion 12 of the housing 10 along the longitudinal direction LD so that the press-in portions 23, 25 of the terminals 20 can be pressed into the press-in holes 17. Accommodating portions 18 are formed at the rear sides of the press-in holes 17 and open in the rear end surface of the terminal accommodating portion 12 for accommodating the receiving portions 27. Steps 18*a* are formed where the accommodating portions 18 connect with the press-in holes 17. The accommodating portions 18 are widened towards the back and are angled with respect to the longitudinal direction LD.

The terminal 20 is pressed into the housing 10 by inserting the tab 21 into the press-in hole 17 of the housing 10 from behind. The terminal-pressing jig then is brought into contact with the receiving surface 27*a* of the receiving portion 27 on the terminal 20 to push the terminal 20 forward in the inserting direction ID (leftward in FIG. 4). Thus, the press-in pieces 24*a*, 24*b*, 26*a*, 26*b* of the press-in portions 23, 25 of the terminal 20 are pressed into the press-in hole 17. The pressing of the terminal 20 into the housing 10 is completed when the front surface of the receiving portion 27 of the terminal 20 contacts the step 18*a* as the press-in pieces 24*a*, 24*b*, 26*a*, 26*b* are pressed into the press-in hole 17. The pressing of the terminal 20 into the housing 10 may be completed when the terminal-pressing jig contacts the rear end surface 12*a* of the terminal-accommodating portion 12.

As shown in FIG. 5, the middles of the leading ends 24*c*, 24*d* of the press-in pieces 24*a*, 24*b* are substantially on diagonal corners of the press-in hole 17 and engage opposite corners 17*a*, 17*c* of the press-in hole 17. In this regard, the rectangular cross section of the press-in hole 17 substantially coincides with the virtual rectangle RS is substantially circumscribed by the imaginary circle IC. Similarly, the middles of the leading ends 26*c*, 26*d* of the press-in pieces 26*a*, 26*b* are substantially on diagonal corners of the press-in hole 17 and engage opposite corners 17*b*, 17*d* of the press-in hole 17. The press-in pieces 24*a*, 24*b*, 26*a*, 26*b* are distributed circumferentially around the circumference of the imaginary circle IC. More than two press-in pieces could be provided per press-in portion and more than two press-in portions could be provided on the base 22. In this case, the press-in pieces are distributed substantially equally over the circumference of the imaginary circle.

Corners 24*e*1, 24*e*2 at the opposite ends of the leading end 24*c* of the press-in piece 24*a* scrape and engage the walls 17*e*, 17*f* that define the corner 17*a* of the press-in hole 17 when the terminal 20 is pressed into the press-in hole 17. Similarly, corners 24*f*1, 24*f*2 at the opposite ends of the leading end 24*d* of the press-in piece 24*b* scrape and engage the walls 17*g*, 17*h* that define the corner 17*c* of the press-in hole 17. Further, corners 26*e*1, 26*e*2 at the opposite ends of the leading end 26*c* of the press-in piece 26*a* scrape and engage the walls 17*e*, 17*h* that define the corner 17*d* of the press-in hole 17. Finally, corners 26*f*1, 26*f*2 at the opposite ends of the leading end 26*d*of the press-in piece 26*b* scrape and engage the walls 17*g*, 17*f* that define the corner 17*b* of the press-in hole 17.

The respective press-in pieces 24*a*, 24*b*, 26*a*, 26*b* of the terminal 20 are displaced from each other when the terminal 20 is viewed in longitudinal direction LD. Thus, the press-in pieces 24*a*, 24*b*, 26*a*, 26*b* do not scrape the housing 10 at the same position when the terminal 20 is pressed into the housing 10. As a result, the connector 1 has large forces for holding the terminals 20 in the housing 10. Further, the widths of the respective press-in pieces 24*a*, 24*b*, 26*a*, 26*b* do not differ from each other, and the terminals 20 and the connector 1 can be miniaturized.

The middles of the leading ends 24*c*, 24*d*, 26*c*, 26*d* of the respective press-in pieces 24*a*, 24*b*, 26*a*, 26*b* are substantially on the diagonal corners of the rectangle RS or on the imaginary circle IC and are engaged with the four corners 17*a*, 17*b*, 17*c*, 17*d* of the press-in hole 17 when the terminal 20 is pressed into the housing 10. Thus, the terminal 20 can be pressed into the middle part of the press-in hole 17 in a well-balanced manner, and variations in the positions of the terminals 20 in the housing 10 can be reduced.

Further, the corners 24*e*1, 24*e*2, 24*f*1, 24*f*2, 26*e*1, 26*e*2, 26*f*1, 26*f*2 at the leading ends 24*c*, 24*d*, 26*c*, 26*d* of the respective press-in pieces 24*a*, 24*b*, 26*a*, 26*b* are engaged with the walls 17*e*, 17*f*, 17*g*, 17*h* that define the corners 17*a*, 17*b*, 17*c*, 17*d* of the press-in hole 17 when the terminal 20 is pressed into the press-in hole 17. Thus, the housing 10 is scraped at eight distributed positions by the press-in pieces 24*a*, 24*b*, 26*a*, 26*b*. The holding force of the terminal 20 is increased and a scraped amount is reduced at each press-in position of the housing 10. Therefore, the connector 1 can be miniaturized by reducing the scraped amount of the housing 10.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Three or more press-in portions may be formed along the longitudinal direction LD of the terminal.

It is not necessary to form each press-in portion from two press-in pieces and each press-in portion may include one, three or more press-in pieces.

The invention also is applicable to connectors other than those to be mounted on electronic circuit boards.

What is claimed is:

1. A terminal, comprising:

a tab connectable with a mating terminal;

a base extending from the tab; and a plurality of press-in portions arranged substantially side by side along a longitudinal direction on the base, each press-in portion including press-in pieces projecting out from the base and to be pressed into a housing;

wherein the press-in pieces are displaced from each other when the terminal is viewed in the longitudinal direction, and wherein the press-in portions each have a substantially crank-shape.

2. A terminal, comprising:

a tab connectable with a mating terminal;

a base extending from the tab; and a plurality of press-in portions arranged substantially side by side along a longitudinal direction on the base, each press-in portion including press-in pieces projecting out from the base and to be pressed into a housing;

wherein the press-in pieces are displaced from each other when the terminal is viewed in the longitudinal direction, and wherein two press-in portions are arranged substantially side by side along the longitudinal direction, each press-in portion including two press-in pieces projecting from the base in substantially opposite directions and having leading ends located on diagonal corners of a rectangle.

3. The terminal of claim 2, wherein the press-in pieces have leading ends thereof located on an imaginary circle.

4. The terminal of claim 3, wherein the leading ends of the press-in pieces are circumferentially distributed around the imaginary circle.

5. The connector of claim 4, wherein the press-in pieces (24*a*, 24*b*; 26*a*, 26*b*) have leading ends on an imaginary circle (IC) and a cross-section of the cavity (17) is inscribed into the imaginary circle (IC).

6. A terminal comprising a tab and a base extending from the tab , the tab and the base extending along an axis defining a longitudinal direction, at least three press-in pieces projecting out from the base and displaced circumferentially from each other about the axis, two of said press-in pieces projecting from the base in substantially opposite directions and having leading ends located on diagonal corners of a rectangle.

7. The terminal of claim 6, wherein the press-in pieces are displaced substantially symmetrically about the axis.

8. The terminal (20) of claim 6, wherein each press-in piece (24*a*, 24*b*; 26*a*, 26*b*) has two corners (24*e*1-2, 24*f*1-2, 26*e*1-2, 26*f*1-2), the corners (24*e*1-2, 24*f*1-2, 26*e*1-2, 26*f*1-2) being displaced circumferentially about the axis.

9. The terminal of claim 6, comprising four of said press-in pieces.

10. The terminal of claim 6, wherein at least one of said press-in pieces is displaced along the axis from the other of said press-in pieces.

* * * * *